US011037543B2

(12) United States Patent
Viard et al.

(10) Patent No.: US 11,037,543 B2
(45) Date of Patent: Jun. 15, 2021

(54) SUBWAVELENGTH ACOUSTIC METAMATERIAL WITH TUNABLE ACOUSTIC ABSORPTION

(71) Applicant: Massachusetts Institute of Technology, Cambridge, MA (US)

(72) Inventors: Nicolas Viard, Cambridge, MA (US); Nicholas Fang, Lexington, MA (US)

(73) Assignee: MASSACHUSETTS INSTITUTE OF TECHNOLOGY, Cambridge, MA (US)

( * ) Notice: Subject to any disclaimer, the term of this patent is extended or adjusted under 35 U.S.C. 154(b) by 604 days.

(21) Appl. No.: 15/767,274

(22) PCT Filed: Oct. 27, 2016

(86) PCT No.: PCT/US2016/059069
§ 371 (c)(1),
(2) Date: Apr. 10, 2018

(87) PCT Pub. No.: WO2017/075187
PCT Pub. Date: May 4, 2017

(65) Prior Publication Data

US 2019/0139529 A1 May 9, 2019

Related U.S. Application Data

(60) Provisional application No. 62/248,377, filed on Oct. 30, 2015.

(51) Int. Cl.
*G10K 11/172* (2006.01)
*G10K 11/162* (2006.01)

(52) U.S. Cl.
CPC ..... *G10K 11/172* (2013.01); *G10K 11/162* (2013.01)

(58) Field of Classification Search
CPC ..... G10K 11/172; G10K 11/162
See application file for complete search history.

(56) References Cited

U.S. PATENT DOCUMENTS 3,991,849 A 11/1976 Green et al.
9,324,312 B2 * 4/2016 Berker ..... E04B 1/86
9,607,600 B2 * 3/2017 Swallowe ..... G10K 11/172
(Continued)

OTHER PUBLICATIONS

International Preliminary Report on Patentability for PCT Appl. No. PCT/US2016/059069 dated May 11, 2018; 7 pages.
(Continued)

*Primary Examiner* — Jeremy A Luks
(74) *Attorney, Agent, or Firm* — Daly Crowley Mofford & Durkee

(57) ABSTRACT

Described is an acoustic absorbing structure and system provided from a composite material having one or more channels provided therein with each of the one or more channels having an aperture opening onto a surface of the composite material. The channels are provided having a cross-sectional shape and dimensions selected to exhibit a low frequency resonance in response to a low frequency sound wave provided thereto such that acoustic absorbing structure has a predetermined response characteristic in response to an acoustic signal provided thereto. Techniques for operating an acoustic absorbing system are also described.

11 Claims, 12 Drawing Sheets

(56) References Cited

U.S. PATENT DOCUMENTS

| | | | | |
|---|---|---|---|---|
| 2011/0005859 | A1* | 1/2011 | Berker | G10K 11/172 181/224 |
| 2015/0279345 | A1 | 10/2015 | Mathur | |
| 2018/0023599 | A1* | 1/2018 | Hussein | B64C 21/10 137/1 |

OTHER PUBLICATIONS

Zhang, "Acoustic Metamaterial Design and Applications;" Dissertation: University of Illinois at Urbana-Champaign, Jan. 2010; 188 pages.

PCT Search Report of the ISA for International Appl. No. PCT/US2016/059069 dated May 5, 2017; 5 pages.

PCT Written Opinion of the ISA for International Appl. No. PCT/US2016/059069 dated May 5, 2017; 10 pages.

Lagarrigue et al., Parametic study of a metaporous made of solid inclusions embedded in a rigid frame porous material; Apr. 23, 2012, HAL archives-ourvertes. fr, pp. 1931-1936, 7 pages.

* cited by examiner

SUBWAVELENGTH ACOUSTIC METAMATERIAL WITH TUNABLE ACOUSTIC ABSORPTION

CROSS REFERENCE TO RELATED APPLICATIONS

This application is a U.S. National Stage of PCT application PCT/US2016/059069 filed in the English language on Oct. 27, 2016 and entitled "SUBWAVELENGTH ACOUSTIC METAMATERIAL WITH TUNABLE ACOUSTIC ABSORPTION," which claims the benefit under 35 U.S.C. § 119 of provisional application No. 62/248,377 filed Oct. 30, 2015, which application is hereby incorporated herein by reference.

BACKGROUND

As is known in the art, sounds waves have a wavelength proportional to their frequency. Thus, low frequency sounds have correspondingly large wavelengths. This makes low frequency sounds difficult to cancel (or even to interact with) without having a large volume of dampening materials. This, in turn, makes it relatively challenging to design a low volume, lightweight material that can significantly interact with or dampen low frequency sounds and adapt to different environments.

As is also known, one technique for interacting with low frequency sounds utilizes gas bubbles (i.e. a sphere having no openings) in liquids. The gas bubbles are characterized by a low frequency resonance (i.e. the Minnaert frequency), corresponding to monopolar/volume oscillations for which the acoustic wavelength is much greater than the size of the object. Briefly, the acoustic wave sets the bubble into oscillation. In return, the bubble re-radiates acoustic waves. Not all oscillation energy is re-radiated into acoustic waves, as part of it is lost as heat through thermo-viscous losses.

The Minnaert frequency of a bubble, hence the frequency region of its absorption peak, depends upon the size of the bubble, the static pressure inside the bubble, and characteristics of the surrounding medium (e.g. density and rigidity of the medium surrounding the bubbles). However, as the gas bubble in a liquid is closed (by definition), its properties (e.g. Minnaert frequency) are fixed. This limits, and in some cases prohibits, changes to the system. This is particularly true if the material surrounding the bubble is an elastic medium. This mechanism (i.e. gas bubble in a liquid) has been used to provide thin sheets of soft, elastic material having bubbles formed therein. Such materials may be used to reduce a sonar signature of an object. For example, by coating or otherwise disposing such a material over all or a portion of a surface of a submarine, the sonar signature of the submarine may be reduced.

SUMMARY

In accordance with one aspect of the concepts, systems and methods described herein, it has been recognized that the use of channels (e.g. hollow cylinders) as resonant inclusions in a soft elastic matrix material may be used to provide an absorbing structure having a tunable acoustic absorption characteristic. Such absorbing structures may be used to achieve attenuation in transmission of signals having wavelengths up to ten times or more greater than a thickness of the absorbing structure. Such structures find use in a wide range of applications including, but not limited to use as tunable transmission/absorption elements and acoustic switches, sound and vibration mitigation, skin treatment, enhance ultrasonic healing, promotion of healing/drug delivery close to the skin, use in the automobile and aircraft industries such as thin coating on the frame of a car or airplane (in place of or in addition to foam) to dampen vibrations. Other applications are also possible.

In accordance with one aspect of the concepts, systems and methods described herein, a subwavelength acoustic metamaterial comprises a composite material having one or more channels provided therein with each of the one or more channels having an aperture opening onto at least one surface of the composite material.

With this particular arrangement, a subwavelength acoustic metamaterial capable of a tunable acoustic absorption characteristic is provided. Since the channels have an aperture opening, a gas or fluid may be introduced into at least a portion of one or more of the channels. In some embodiments, a gas or fluid may be injected or otherwise introduced into each channel. In some applications, it may be desirable that the same gas or fluid be introduced into each channel. In some applications, it may be desirable that a first gas or fluid be introduced into first ones of the channels and a second, different gas or fluid be introduced into second ones of the channels. In some applications, it may be desirable that a different gas or fluid be introduced into each channel. In some applications, it may be desirable that the same amount of gas or fluid be introduced into each channel. In some applications, it may be desirable for some or all of the channels to have a different amount of gas or fluid introduced therein. In some applications, it may be desirable that a first amount of gas or fluid be introduced into first ones of the channels and a second, different amount of gas or fluid be introduced into second ones of the channels. In some applications, it may be desirable that a different amount of gas or fluid be introduced into different ones of the channels. In some applications, it may be desirable to introduced a combination of a gas and fluid into the same channel. In some applications, it may be desirable to introduced a combination of a gas and fluid into some or all of the channels. Various combinations of gas and/or fluid types and amounts of gas and/or fluid may also be used. In short, the type of gas and/or fluid, the amount of gas and/or fluid and whether a combination of gas and fluid should be used in any or every channel may be selected in accordance with the needs of a particular application. In some embodiments, the channels may be provided having a generally regular geometric shape (e.g. a generally circular, square, rectangular, triangular or substantially polygonal shape). In some embodiments, the channels may be provided having an irregular geometric shape. The particular cross-sectional shape with which to provide channels may be selected in accordance with the needs of a particular application. In some embodiments, the channels may be provided having a circular cross-sectional shape. In some embodiments, it may be desirable or necessary for channels to have different cross-sectional shapes. For example, first ones of the channels may be provided having a first cross-sectional shape and second ones of the channels may be provided having a second, different first cross-sectional shape. Also, in some embodiments, the channels may all have substantially the same cross-sectional shape, but may have different dimensions (e.g. first ones of the channels may be provided having a generally circular cross-sectional shape having a first diameter and second ones of the channels may be provided having a generally circular cross-sectional shape having a second, different diameter).

In some embodiments, a subwavelength acoustic metamaterial may be provided from a plurality of composite materials, each composite material having one or more channels provided therein with each of the one or more channels having an aperture opening onto a respective surface of the respective composite material. In some embodiments, the channel apertures may open onto the same surface of a composite material and in other embodiments, some channel apertures may open onto a first surface of a composite material while other channel apertures may open onto a second different surface of the composite material (i.e. each channel aperture need not open onto the same surface of the composite material in which the channel is disposed).

In some embodiments, the channels may be provided having a generally regular geometric shape (e.g. a generally circular, square, rectangular, triangular or substantially polygonal shape). Each composite material may be provided having channels having the same or different cross-sectional shapes or having the same cross-sectional shapes but having different dimensions. The channels in each of the plurality of composite materials may be provided having a regular or an irregular geometric shape. The particular cross-sectional shape with which to provide channels may be selected in accordance with the needs of a particular application. In some embodiments, the channels may be provided having a circular cross-sectional shape. In some embodiments, it may be desirable or necessary for channels to have different cross-sectional shapes. For example, first ones of the channels may be provided having a first cross-sectional shape and second ones of the channels may be provided having a second, different first cross-sectional shape. Also, in some embodiments, the channels may all have substantially the same cross-sectional shape, but may have different dimensions (e.g. first ones of the channels may be provided having a generally circular cross-sectional shape having a first diameter and second ones of the channels may be provided having a generally circular cross-sectional shape having a second, different diameter).

In some embodiments, a multilayer acoustic absorber comprises a plurality of composite materials disposed such that adjacent surfaces are in contact to provide a stack of composite materials. Each composite material in the stack is provided having one or more channels provided therein with each of the one or more channels having an aperture opening onto a respective surface of the respective composite materials. A fluid or gas is disposed in the channels of the various composite materials in the stack such that each one of the plurality of composite materials responds to signals having a different frequency.

With this particular arrangement, a stack of subwavelength acoustic metamaterials having tunable acoustic absorption is provided. In one embodiment, a different fluid or gas may be disposed in some or all of the channels. The type and amount of fluid and/or gas to disposed in each channel is selected such that each subwavelength acoustic metamaterial in the stack of subwavelength acoustic metamaterials responds to a signal having a selected, different frequency (i.e. each subwavelength acoustic metamateral in the stack responds to a different frequency). Thus, the order in which the each subwavelength acoustic metamaterial is arranged to form the stack is selected based, at least in part, upon some or all of: the needs of a particular application; characteristics of the medium surrounding the stack of subwavelength acoustic metamaterials; and the characteristics of a substrate (if any) on which the stack of subwavelength acoustic metamaterials is disposed. In some embodiments, the channel apertures may open onto the same surface of the composite material in which the channels are formed or otherwise provided and in other embodiments, some channel apertures may open onto a first surface of the composite material in which the channels exist while other channel apertures may open onto a second different surface of the composite material in which the channels exist (i.e. each channel aperture need not open onto the same surface of the composite material in which the channel is formed or otherwise provided).

In accordance with a further aspect of the concepts, systems and techniques described herein, an acoustic absorbing system includes a pumping system having a pump with an output coupled to one or more pump ports of a piping system. The piping system includes one or more absorber ports coupled to one or more ports of at least one channel provided in a composite material.

With this particular arrangement, a system for providing a tunable acoustic absorption characteristic is provided. The pumping system may inject or otherwise introduce a fluid or a gas into one or more the channels provided in the composite material so as to provide a system having a subwavelength acoustic metamaterial with a tunable acoustic absorption characteristic. By pumping (or otherwise injecting or introducing) fluid or gas into the channels or pumping fluid or gas out of the channels (i.e. or removing fluid or gas from some or all of channels) the system is provided having a tunable acoustic absorption characteristic in accordance a further aspect of the concepts, systems and methods described herein, a subwavelength acoustic metamaterial comprises a composite material having one or more channels provided therein with at least one end of at least one channel having an aperture opening onto one surface of the composite material.

With this particular arrangement, a subwavelength acoustic metamaterial capable of a tunable acoustic absorption characteristic is provided. Since at least one of the one or more channels has an aperture, a gas or fluid may be disposed in at least a portion of one or more of the channels. In preferred embodiments, a plurality (or all) of the channels may have their own respective aperture through which a gas or fluid may be injected or otherwise introduced into each channel. In some applications, it may be desirable that the same gas or fluid be introduced into each channel. In some applications, it may be desirable that a first gas or fluid be introduced into first ones of the channels and a second, different gas or fluid be introduced into second ones of the channels. In some applications, it may be desirable that a different gas or fluid be introduced into each channel. In some applications, it may be desirable that the same amount of gas or fluid be introduced into each channel. In some applications, it may be desirable that a first amount of gas or fluid be introduced into first ones of the channels and a second, different amount of gas or fluid be introduced into second ones of the channels. In some applications, it may be desirable that a different amount of gas or fluid be introduced into each channel. In some applications, it may be desirable to introduced a combination of a gas and fluid into some or all of the channels. Other combinations of gas and/or fluid types and amounts of gas and/or fluid may also be used. In short, the type of gas and/or fluid, the amount of gas and/or fluid and whether a combination of gas and fluid should be used in each channel may be selected in accordance with the needs of a particular application.

In accordance with one aspect of the concepts, systems and methods described herein, a composite material comprises a soft, elastic matrix material having one or more channels provided therein. In one embodiment the channels correspond to hollow cylinders. By appropriately selecting the dimensions of the one or more channels, when driven by a low frequency sound wave, a wall which defines the hollow cylinder oscillates isotropically in a plane perpendicular to a central longitudinal axis of the hollow cylinder. Stated differently, it could be said that the hollow cylinder pulses.

With this particular arrangement, a subwavelength acoustic metamaterial having tunable acoustic absorption is provided. Furthermore, by providing an elastic material having one or more hollow channels, a light weight, low volume structure is provided.

Such a material finds use in a wide variety of applications including, but not limited to use in the automobile and aircraft industries. Because of its light weight and low volume, the subwavelength acoustic metamaterial having tunable acoustic absorption described herein may lead to significant decreases in fuel consumption in a wide variety of industries including, but not limited to, automotive and aircraft industries. Thus, such a material may be used to reduce carbon dioxide ($CO_2$) emissions.

Hollow cylinders (the equivalent of a sphere in a two dimensional space) do not exist in liquids but can be fabricated in elastic materials. As with hollow spheres in a soft elastic material, hollow cylinders will exhibit a low frequency resonance, an analogue of the Minnaert frequency, as long as the surrounding elastic material is soft enough.

In one embodiment, the composite material may be provided from silicone rubber. In one embodiment, the material may be provided from silicone gel. In one embodiment, the material may be provided from a hydro-gel. It should, of course, be appreciated that any material having similar mechanical characteristics may also be used and the above are merely examples of materials that meet a desired softness (i.e. shear modulus inferior to 2 MPa).

In accordance with one aspect of the concepts described herein, a subwavelength acoustic metamaterial capable of a tunable acoustic absorption characteristic is provided from a composite material having hollow cylinders provided therein. Some advantages of using hollow cylinders are: the material fabrication is much simpler than in the case of hollow spheres; be having an exposed aperture, it is relatively easy to change a static pressure in the cylinders thereby easily resulting in a change of the resonance frequency, hence the absorption region of the material; and similarly, the air in the cylinders may be replaced by a much denser fluid or gas or a fluid or gas having a density which is the same as or similar to the density as the of the elastic matrix (i.e. the composite material). The introduction of such a fluid or gas results in a radical change of the composite material properties.

It should also be mentioned that the proper functioning of the composite material described herein depends upon the proper coupling between the medium the acoustic wave is propagating in, and the composite material itself. In other words, for the acoustic wave to be absorbed (rather than reflected) by the composite structure described herein, the acoustic wave must be able to penetrate the structure. This requirement restricts—at that moment—the use of a composite material in a medium of similar density (to lower the acoustic impedance mismatch).

In accordance with a still further aspect of the concepts described herein, an acoustic switch for use in under water acoustics may include a plurality of PET wires disposed in a single plane, parallel to each other and equally spaced over a three-dimensional (3D) printed mold having a desired thickness. The plane of the wires is spaced a predetermined distance above the floor of a mold. Once the mold is cured, the wires may be stripped off resulting in a soft elastic (PDMS) sheet (E around 1 MPa), with parallel empty (air filled) cylinders, regularly spaced (i.e. a constant pitch or lattice constant) on a plane in the middle of the sheet.

In one embodiment, tens of PET wires are used and each of the PET wires are provided having a diameter of about 100 microns. The wires stretched onto a single plane over a 3D mold having a thickness of 2 mm. In one embodiment the wires are equally spaced by 2 mm (i.e. a 2 mm pitch). The plane of the wires is disposed about 1 mm above a floor of the mold. IN one embodiment the mold is cast with polydimethylsiloxane (PDMS/silicone rubber). Once the latter is cured, the wires are carefully removed from the sample. The resulting sample is a 2 mm thick soft elastic (PDMS) sheet ($\mu$ around 1 MPa), with parallel empty (air filled) cylinders, regularly spaced (pitch or lattice constant equal to 2 mm) on a plane in the middle of the sheet.

As noted above, the concepts, structures, systems and techniques described herein find use in a wide range of applications including, but not limited to use as tunable transmission/absorption elements and acoustic switches, sound and vibration mitigation, skin treatment, enhance ultrasonic healing and promotion of healing/drug delivery close to the skin.

With respect to use for enhancing ultrasonic healing, the structure described herein (e.g. sheet with hollow cylinders) could be used to convert ultrasonic energy to heat and/or promote healing/drug delivery close to the skin.

As also noted above, the concepts, structures, systems and techniques described herein find use in automobile and aircraft industries. With respect to use in the automobile and aircraft industries the structures described herein may be used as a coating on a frame of a car or airplane or other vehicle (e.g. in place of or in addition to foam) to dampen vibrations. As the vehicle (e.g. car) changes speed, the frequency of noise and vibration changes. The concepts, structures and techniques described herein may be used to adapt the natural frequency of the coating by changing the pressure inside the channels (e.g. by introduction of or removal form fluid and/or gas from hollow cylinders).

BRIEF DESCRIPTION OF THE DRAWINGS

The foregoing features may be more fully understood from the following description of the drawings in which.

DETAILED DESCRIPTION

Described herein are concepts, systems, circuits and related techniques to provide a subwavelength acoustic metamaterial having a tunable acoustic absorption characteristic.

Figure 1B:
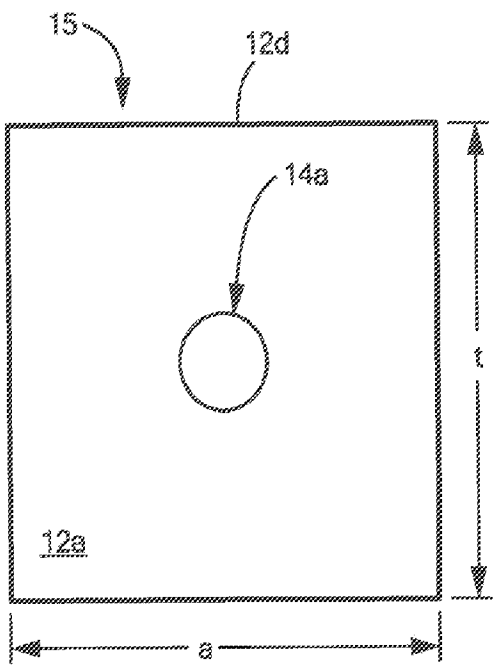
FIG. 1B is a top view of a portion of the acoustic absorber of FIG. 1A, taken along lines 1B-1B in FIG. 1A.
Figure 1A:
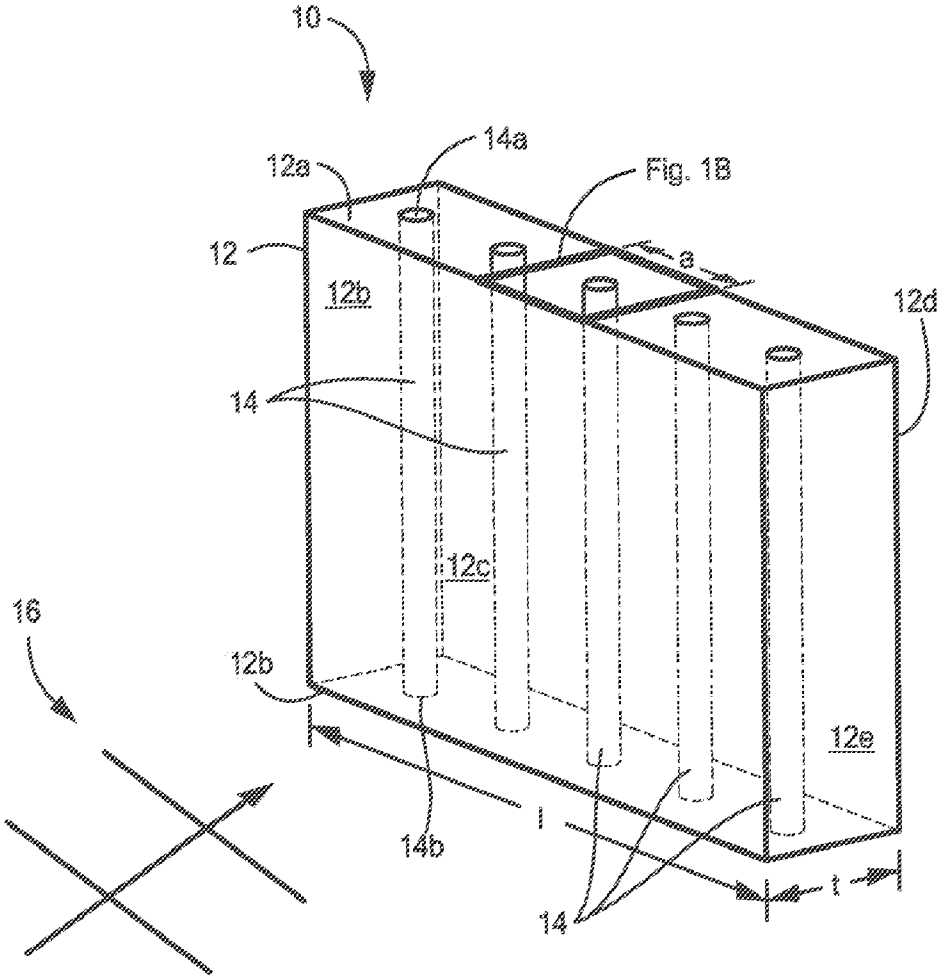
FIG. 1A is an isometric view of an acoustic absorber provided from a composite material having channels provided therein so as to provide a subwavelength acoustic metamaterial having tunable acoustic absorption around one specific frequency.

Referring now to FIGS. 1A and 1B in which like elements are provided having like reference designations, a portion of an acoustic absorbing structure 10 having a tunable acoustic absorption characteristic is provided from a composite material 12 having a top surface 12*a*, a bottom surface 12*b*, front and back surfaces 12*c*, 12*d* and side surfaces 12*e*, 12*f* and having one or more channels 14 provided therein. Here, a plurality of channels are shown, however it should be appreciated that in some applications composite material 12 may be provided having only a single channel 14. In this illustrative embodiment, the channels are shown as hollow cylinders imbedded in a soft elastic matrix and arranged as an array.

Such signal absorbing structures may be used to achieve attenuation or reflection of signals having wavelengths at least ten times greater than a thickness of the absorbing structure. Thus, the acoustic absorbing structures described here are sometimes also referred to herein as a subwavelength acoustic metamaterial having a tunable acoustic absorption characteristic.

Significantly, at least one of the one or more channels 14 is provided having at least one aperture opening onto at least one surface of the composite material 12. Material 12 is preferably provided as an isotropic elastic material or medium which for purposes of this disclosure is defined as having shear modulus mu<<bulk modulus K. If the medium 12 is sufficiently soft (mu<about 10 MPa<<K), the channel, possesses a low frequency resonance similar to the Minnaert resonance of a bubble. It should be appreciated that isotropic elastic media only need a pair of elastic constants which can be the bulk modulus K and the shear modulus mu to describe their elastic behavior. Other more complex elastic media (anisotropic media) need more elastic constants. Orthotropic materials for example need 9 elastic constants to fully describe their elastic behavior.

In one embodiment, the material may be provided from silicone rubber. In one embodiment, the material may be provided from silicone gel. In one embodiment, the material may be provided from a hydro-gel. It should, of course, be appreciated that any material having similar structural and acoustic characteristics may also be used and the above are merely examples of materials that meet a desired softness (i.e. shear modulus inferior to 10 MPa).

In this illustrative embodiment, channels 14 are each provided having a first aperture 14*a* open to composite material surface 12*a* and having a second aperture 14*b* open to composite material surface 12*b*. Since channels 14 have exposed apertures 14*a*, 14*b*, the channels can be filled, in whole or in part, with a fluid and/or a gas. Depending at least upon the type and amount of fluid and/or a gas introduced into the channels 14, the structure 10 is responsive to acoustic signals 16 have a particular wavelength or acoustic signals 16 having a wavelength within a particular range of wavelengths.

In this manner, structure 10 is provided as a subwavelength acoustic metamaterial having a tunable acoustic absorption characteristic. Since the channels have an aperture exposed (or open to) to a surface of composite material 12, a gas or fluid may be introduced into at least a portion of one or more of the channels. In some embodiments, a gas or fluid may be injected or otherwise introduced into each channel. In some applications, it may be desirable that the same gas or fluid be introduced into each channel. In some applications, it may be desirable that a first gas or fluid be introduced into first ones of the channels and a second, different gas or fluid be introduced into second ones of the channels. In some applications, it may be desirable that a different gas or fluid be introduced into each channel. In some applications, it may be desirable that the same amount of gas or fluid be introduced into each channel. In some applications, it may be desirable for some or all of the channels to have a different amount of gas or fluid introduced therein. In some applications, it may be desirable that a first amount of gas or fluid be introduced into first ones of the channels and a second, different amount of gas or fluid be introduced into second ones of the channels. In some applications, it may be desirable that a different amount of gas or fluid be introduced into different ones of the channels. In some applications, it may be desirable to introduced a combination of a gas and fluid into the same channel. In some applications, it may be desirable to introduced a combination of a gas and fluid into some or all of the channels. Various combinations of gas and/or fluid types and amounts of gas and/or fluid may also be used. In short, the type of gas and/or fluid, the amount of gas and/or fluid and whether a combination of gas and fluid should be used in any or every channel may be selected in accordance with the needs of a particular application.

In the illustrative embodiment of FIG. 1A, the channels are shown as having a generally (or substantially) circular cross-section shape. It should, of course be appreciated that any regular geometric shape (e.g. a generally circular, square, rectangular, triangular or substantially polygonal shape) or irregular shape may be used.

In some embodiments, the channels may be provided having a regular of irregular geometric shape selected to provided the structure 12 having a desired strength in response to contact forces, for example (e.g. an ability to withstand, particular forces such as tension, normal, shear or applied forces to which structure 10 may be subject in a particular application).

The particular cross-sectional shape with which to provide channels may be selected in accordance with the needs of a particular application. In some embodiments, the channels may be provided having a circular cross-sectional shape. In some embodiments, it may be desirable or necessary for channels to have different cross-sectional shapes. For example, first ones of the channels may be provided having a first cross-sectional shape and second ones of the channels may be provided having a second, different first cross-sectional shape. Also, in some embodiments, the channels may all have substantially the same cross-sectional shape, but may have different dimensions (e.g. first ones of the channels may be provided having a generally circular cross-sectional shape having a first diameter and second ones of the channels may be provided having a generally circular cross-sectional shape having a second, different diameter).

In one embodiment, an acoustic absorbing structure 10 may be provided from a silicone rubber sheet having regularly spaced channels. In this embodiment, the channels are provided as hollow cylinders. Edges of the sheet may be sealed to prevent water or other undesirable fluids from entering channels 14 provided in the sheet.

In one embodiment, some or all of channels 14 may be provided having only one aperture (e.g. one of apertures 14*a*, 14*b*) open to a surface of the composite material. Also, after introducing a fluid or gas into some or all of the channels, the aperture(s) may be closed (e.g. in the above-noted manner of sealing the edges of a sheet of composite material in which channels are provided).

It should also be appreciated that the channels may be hollow or may be filled (e.g. with a fluid and/or gas) with a material having characteristics different from the characteristics of the composite material. For example, as will be described below in conjunction with FIG. 6A, some or all of the channels 14 may be filled with water so as to attenuate signals provide thereto.

Referring briefly to FIG. 1B, a unit cell 15 has a lattice constant "a" and a width t corresponding to a thickness of material 12. In this illustrative embodiment, a diameter of one channel may range from about 50 to about 200 microns depending upon a frequency range with which it is desirable for the absorber to interact. The lattice constant and material thickness, the size and shape of the channels, and the type and amount of fluid and/or gas to introduce into the channels (i.e. the mechanical, electrical and acoustic characteristics of the fluid as well as the volume of fluid) are selected in accordance with a variety of factors including, but not limited to the frequency (wavelength) of the acoustic signal with which it is desirable to interact, as well as the density and elastic properties of the matrix (since these characteristics are also relevant factors (since they affect the resonance frequency of the channels).

In some embodiments, a subwavelength acoustic metamaterial capable of a tunable acoustic absorption characteristic is provided from a composite material having hollow cylinders provided therein. Some advantages of using hollow cylinders are: the material fabrication is simpler than in the case of hollow spheres; since the cylinders have at least one exposed aperture, it is relatively easy to change a static pressure in the cylinders. Changing a static pressure in the cylinders results in a change of the resonance frequency and hence the absorption region of the material. Similarly, air in the cylinders may be replaced by a much denser fluid or a fluid having a density similar to that of the elastic matrix, which results in a radical change of the composite material properties.

It should also be mentioned that the proper operation of the absorbing system described herein depends upon the proper coupling between the medium in which the acoustic wave is propagating, and the composite material itself. In other words, for the acoustic wave to be absorbed (rather than reflected or otherwise directed) by the composite structure described herein, the acoustic wave must be able to penetrate the structure (i.e. acoustic wave must be able to penetrate the composite material). This requirement may lend itself to the use of composite materials in a medium of similar density (e.g. selecting a composite material having a density which is the same as or similar to density of a medium in which the composite material is disposed so as to lower an acoustic impedance mismatch between an acoustic wave and the composite material).

Although in some embodiments the composite material comprises many aligned hollow cylinders, in other embodiments, the cylinders (or even channels of any cross-sectional shape) need not be aligned.

An analytical expression for the behavior of a unique cylinder, without considering the losses has been developed. This allows one to understand the mechanisms involved in the oscillations of the cylinder and where the tunable ability comes from. The following equation gives the natural frequency of one hollow cylinder of radius R, in an elastic matrix (surface energy is disregarded):

$$f_o = \frac{1}{2\pi R}\sqrt{\frac{2\mu + 2\gamma P_0}{2p}}$$

In which:

- $\mu$ is the shear modulus (also known as rigidity) of the elastic matrix;
- $\gamma$ is the ratio of heat capacities for the gas inside the hollow cylinder;
- $P_0$ is the static pressure inside the hollow cylinder; and
- $\rho$ is the density of the elastic material.

The above expression shows that one hollow cylinder is analogous to a mass-spring system with the mass (or inertia) given by the surrounding elastic material, and a spring with two components: the rigidity of the material and the gas inside the hollow cylinder.

For soft elastic materials like hydro-gel or soft silicone rubber, the shear modulus $\mu$ is of the order of a few hundred kPa, and the two spring components are of the some order of magnitude. This opens a way of varying the natural frequency $f_o$ of the hollow cylinders by changing the pressure $P_0$ inside them. The material thus becomes active and tunable.

Figure 2A:
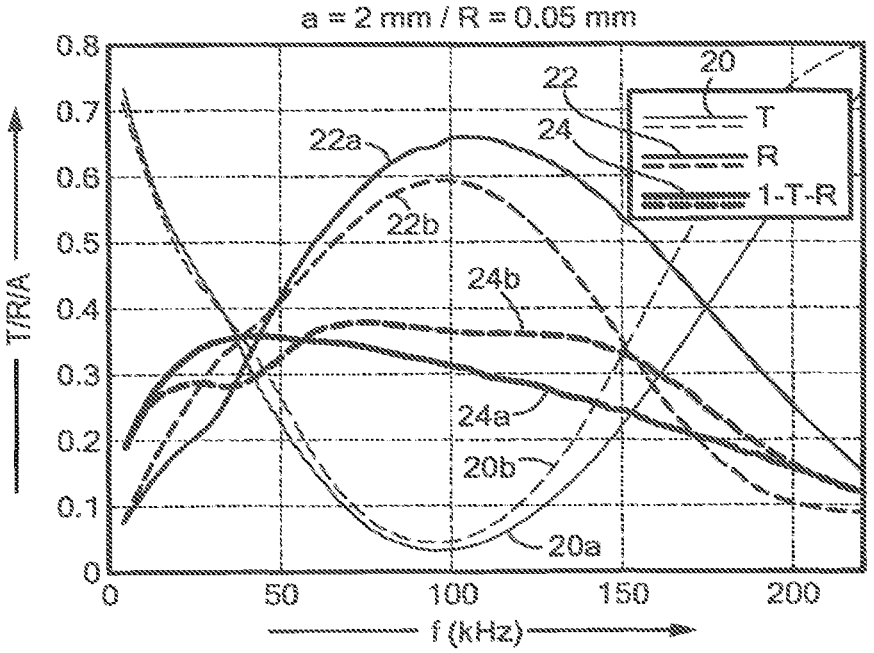
FIG. 2A is a plot of frequency vs. absorption for a subwavelength acoustic metamaterial of the type described in FIGS. 1A, 1B.

Referring now to FIG. 2A a simulated transmission 20, reflection 22 and absorption 24 from an infinite array of hollow cylinders (radius 50 microns) as a function of frequency for lattice constant equal to 2 mm (left) is shown. Solid lines (20*a*, 22*a*, 24*a*) correspond to simulations made for a material thickness t equal to 0.9 mm and dashed lines (20*b*, 22*b*, 24*b*) correspond to simulations made for a material thickness t equal to 2 mm. It should be appreciated that transmission and reflection coefficients T and R are defined as an intensity ratio and thus they are unitless. The absorption coefficient may be determined as A=1−T−R, and thus is also unitless.

Figure 2B:
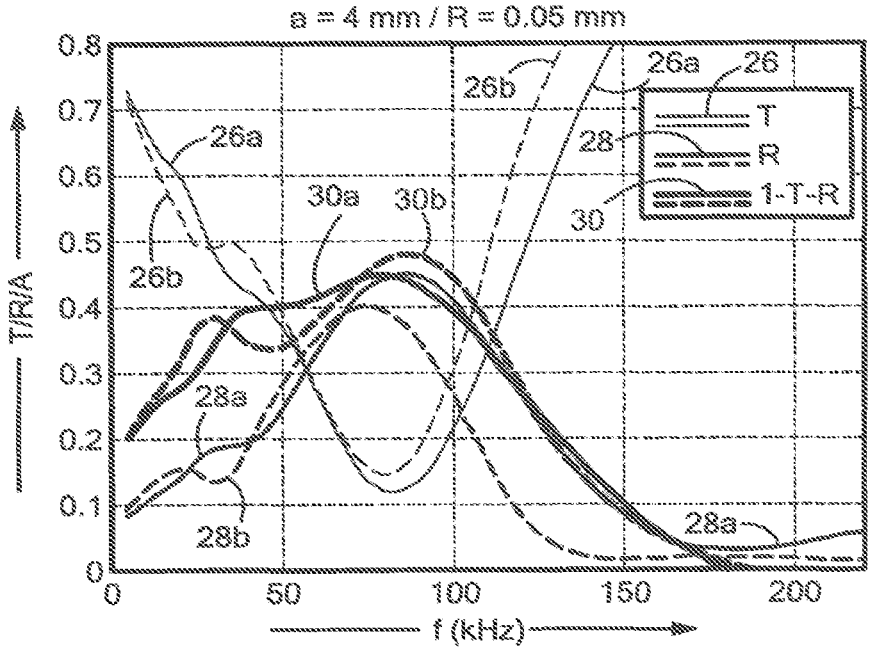
FIG. 2B is a plot of frequency vs. absorption for a subwavelength acoustic metamaterial of the type described in FIGS. 1A, 1B.

Referring now to FIG. 2B a simulated transmission 26, reflection 28 and absorption 30 from an infinite array of hollow cylinders (radius 50 microns) as a function of frequency for lattice constant equal to 4 mm (right) is shown. Solid lines (26*a*, 28*a*, 30*a*) correspond to simulations made for a material thickness t equal to 0.9 mm and dashed lines (26*b*, 28*b*, 30*b*) correspond to simulations made for a material thickness t equal to 2 mm.

FIGS. 2A, 2B thus show the simulation results for the transmission, reflection and absorption from a 0.9 mm thick (solid lines) and 2 mm thick (dashed lines) silicone rubber sheet with 100 microns diameter hollow cylinders. As noted above, the lattice constant a is equal to 2 mm (left) and 4 mm (right). The surrounding medium is water.

At 100 kHz, the wavelength of sound in water is approximately 15 mm which is much larger than the thickness of the material and even much larger than the diameter of the hollow cylinders. Yet, it is around this frequency that the structure described herein is almost opaque to acoustic wave (transmission 0.05). Moreover, the amount of absorption (curves 24, 30) is around 30 to 40% of the total incoming energy. It is important to note that by changing the lattice constant, the absorption peak (illustrated by curves 24, 30) shift from below 50 kHz (FIG. 2A) to about 80 kHz (FIG. 2B). This shows that changing the lattice constant is another way to tune the acoustic/filtering response of the material. One way of changing the lattice constant would be to replace air by water in only some of the hollow cylinders. Indeed, a cylinder of water in silicone rubber (same density) is almost similar from the point of view of an acoustic wave.

Figure 3:
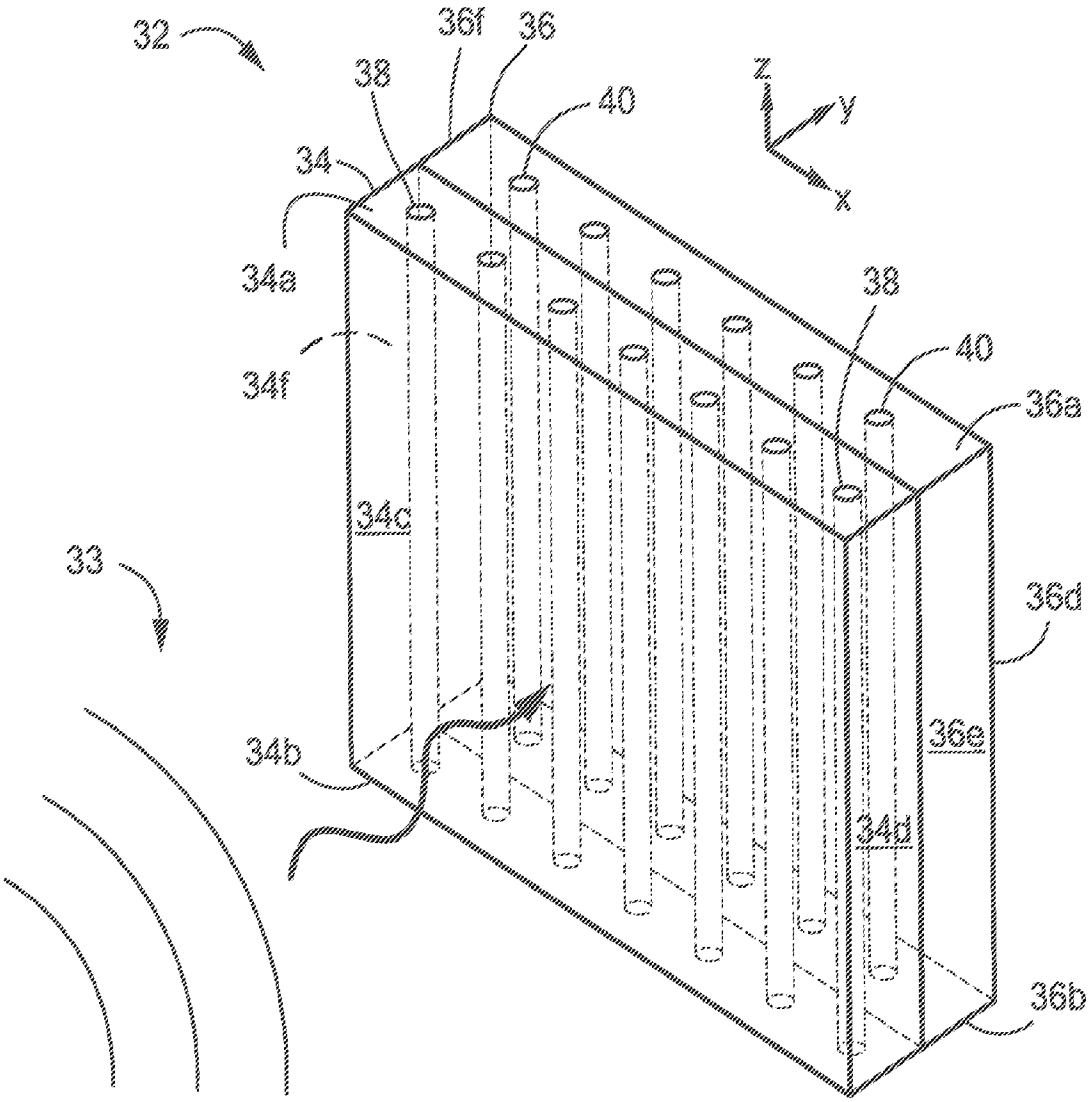
FIG. 3 is a stack of composite materials having channels provided therein so as to provide a subwavelength acoustic metamaterial having tunable acoustic absorption at multiple frequencies.

Referring now to FIG. 3 a portion of an acoustic absorbing structure 32 having a tunable acoustic absorption characteristic is provided from a pair of composite materials 34, 36 each having top, bottom and side surfaces 34*a*-34*d*, 36*a*-36*d* (with surfaces 34*d*, 36*c* not visible in FIG. 3), respectively and each having one or more channels 38, 40 provided therein. Composite materials 34, 36 and channels 38, 40 may be the same as or similar to composite material 12 and channels 14 described above in conjunction with FIGS. 1A and 1B. Thus acoustic absorbing structure 32 is provided from a stack (here, a stack of two) subwavelength acoustic metamaterials each having a tunable acoustic absorption characteristic.

In response to an acoustic wave impinging absorber structure 32, the individual absorbers 34, 36 respond to the acoustic signal 33 and structure 32 provides an overall responsive to acoustic signals 33 have a particular wavelength or acoustic signals 33 having a wavelength within a particular range of wavelengths. As noted above, at least one of the one or more channels 38, 40 is provided having at least one aperture opening onto at least one surface of the respective composite material 34, 36 in which the channel exists. The response characteristics of each individual absorber 34, 36 depends, at least in part, upon the type and amount of fluid and/or a gas (if any) introduced into the channels 38, 40.

Here, each composite material 34, 36 is provided having a plurality of channels. It should, however, be appreciated that in some applications one or both of composite materials 34, 36 may be provided having only a single channel. It should also be appreciated that while channels 38 are all aligned in the X-direction and channels 40 are also all aligned in the X-direction, but in the illustrative embodiment of FIG. 3, the channels 38, 40 are interleaved. Stated differently, channels 38 all have the same Y-position values and channels 40 all have the same Y-position values but channels 38 do not have the same X-position values (i.e. X axis values) as channels 40 (i.e. channels 38, 40 are not aligned in the y direction).

Figure 4:
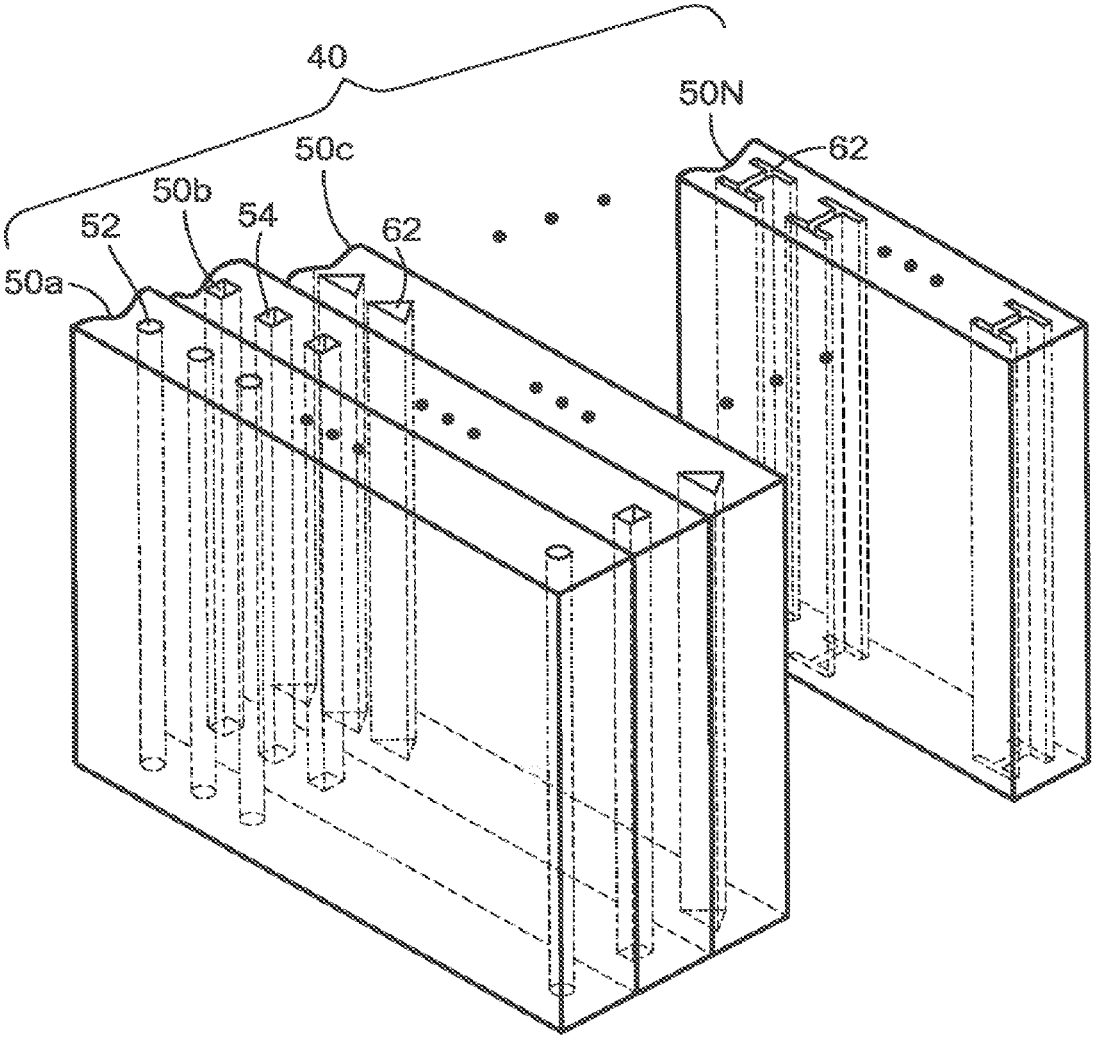
FIG. 4 is a stack of composite materials having channels provided therein so as to provide a subwavelength acoustic metamaterial having tunable acoustic absorption at multiple frequencies.

Referring now to FIG. 4 a portion of an acoustic absorbing structure 40 having a tunable acoustic absorption characteristic is provided from a plurality of, here N, subwavelength acoustic metamaterials each having a tunable acoustic absorption characteristic. Each of the subwavelength acoustic metamaterials are provided from one of composite materials 50*a*-50N each having top, bottom and side surfaces respectively and each having one or more channels 52, 54, 60, 62 provided therein. Composite materials 50*a*-50N and channels 52, 54, 60, 62 may be the same as or similar to composite material 12 and channels 14 described above in conjunction with FIGS. 1A and 1B. Thus, acoustic absorbing structure 32 is provided from a stack (here, a stack of N) subwavelength acoustic metamaterials each having a tunable acoustic absorption characteristic.

As noted above, at least one of the one or more channels 52, 54, 60, 62 is provided having at least one aperture opening onto at least one surface of the respective composite materials in which the channel exists which facilitates introduction of a fluid and/or a gas into the channel(s). Depending at least upon the type and amount of fluid and/or a gas introduced into the channel(s), the structure 40 is responsive to acoustic signals having a particular wavelength or acoustic signals having a wavelength within a particular range of wavelengths.

In this manner, structure 10 is provided as a subwavelength acoustic metamaterial having a tunable acoustic absorption characteristic. Since the channels have at least one aperture exposed (or open to) to a surface of composite material 12, a gas or fluid may be introduced into at least a portion of one or more of the channels. In some embodiments, a gas or fluid may be injected or otherwise introduced into each channel. In some applications, it may be desirable that the same gas or fluid be introduced into each channel. In some applications, it may be desirable that a first gas or fluid be introduced into first ones of the channels and a second, different gas or fluid be introduced into second ones of the channels. In some applications, it may be desirable that a different gas or fluid be introduced into each channel. In some applications, it may be desirable that the same amount of gas or fluid be introduced into each channel. In some applications, it may be desirable for some or all of the channels to have a different amount of gas or fluid introduced therein. In some applications, it may be desirable that a first amount of gas or fluid be introduced into first ones of the channels and a second, different amount of gas or fluid be introduced into second ones of the channels. In some applications, it may be desirable that a different amount of gas or fluid be introduced into different ones of the channels. In some applications, it may be desirable to introduced a combination of a gas and fluid into the same channel. In some applications, it may be desirable to introduced a combination of a gas and fluid into some or all of the channels. Various combinations of gas and/or fluid types and amounts of gas and/or fluid may also be used. In short, the type of gas and/or fluid, the amount of gas and/or fluid and whether a combination of gas and fluid should be used in any or every channel may be selected in accordance with the needs of a particular application.

As illustrative in the embodiment of FIG. 4, the channels may be provided having any desirable shape including any regular geometric shape (e.g. a generally circular, square, rectangular, triangular or substantially polygonal shape) or any irregular shape. As illustrated in FIG. 4, channels 62 are provided having an I-beam shape.

There are a variety of reasons why one might select a particular shape for the channels. For example, the structure stability might be improved by selecting one shape instead of another. Also the channel shape might affect the whole material compliance when it has to be placed on a complex surface (e.g a non-flat surface). At a constant channel volume, the choice of the channel shape will affect the selectivity (the width of the frequency range at which the material absorbs acoustic wave) and the amount of absorbed energy. Other reasons/factors also exist for selecting a channel shape and size including the needs/requirements of a particular application. After reading the disclosure provided herein, those of ordinary skill in the art will appreciate how to select a channel shape and size for a particular application.

In some embodiments, the channels may be provided having a regular or an irregular geometric shape selected to provided the absorbing structure having a desired strength in response to contact forces, for example (e.g. an ability to withstand, particular forces such as tension, normal, shear or applied forces to which structure 10 may be subject in a particular application).

In some embodiments, the channels 52, 54, 60, 62 may be provided having a regular lattice pattern (e.g. a grid lattice pattern, an interleaved pattern or a triangular-shaped lattice pattern) or an irregular lattice pattern. Combinations of lattice patterns may also be used. A variety of factors may be considered in selecting a lattice pattern when forming a multilayer structure as shown in FIG. 4 including, but not limited to recognition that since when forming a multilayer structure, a specific lattice pattern may add interferences and, hence, selection of a specific lattice pattern may possible affect (e.g. attenuate or otherwise mitigate or affect) signals having a specific frequency or signals within a specific range of frequencies.

Furthermore, the particular cross-sectional shape with which to provide channels may be selected in accordance with the needs of a particular application. In some embodiments, the channels may be provided having a circular cross-sectional shape. In some embodiments, it may be desirable or necessary for channels to have different cross-sectional shapes. For example, first ones of the channels may be provided having a first cross-sectional shape and second ones of the channels may be provided having a second, different first cross-sectional shape. Also, in some embodiments, the channels may all have substantially the same cross-sectional shape, but may have different dimensions (e.g. first ones of the channels may be provided having a generally circular cross-sectional shape having a first diameter and second ones of the channels may be provided having a generally circular cross-sectional shape having a second, different diameter).

It should also be appreciated that the channels may be hollow. Alternatively, the channels may be filled (e.g. with a fluid and/or gas) with a material having characteristics different from the characteristics of the composite material. For example, as will be described below in conjunction with FIG. 6A, some or all of the channels may be filled with water so as to attenuate signals provide thereto.

Figure 5B:
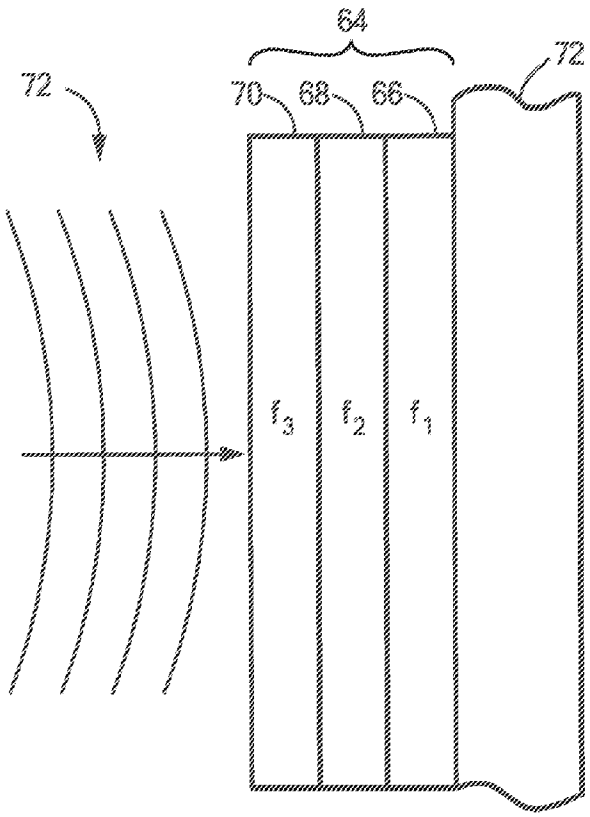
FIG. 5B is a stack of composite materials having channels provided therein.
Figure 5A:
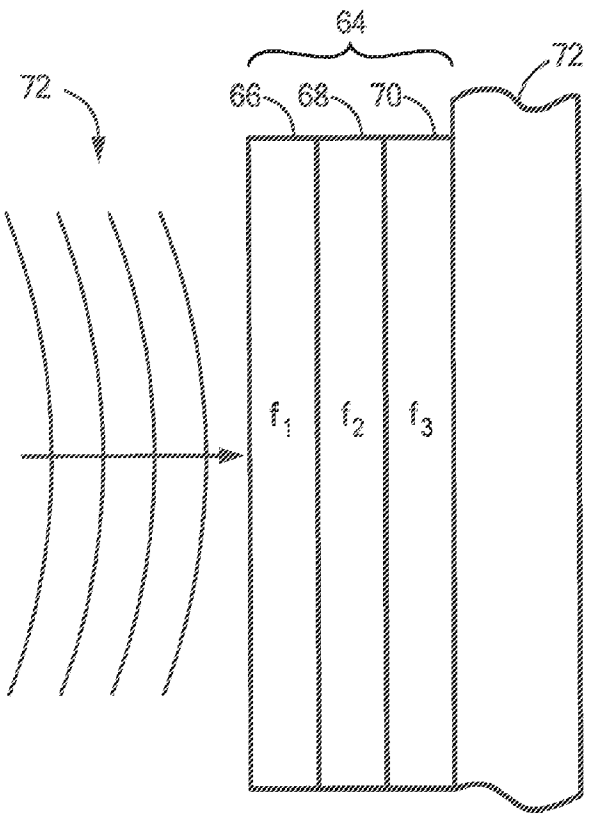
FIG. 5A is a stack of composite materials having channels provided therein.

Referring now to FIGS. 5A and 5B in which like elements are provided having like reference designations, a multilayer acoustic absorber 64 (i.e. an acoustic absorbing structure having a tunable acoustic absorption characteristic) is provided from a plurality of subwavelength acoustic metamaterials 66, 68, 70 each having a tunable acoustic absorption characteristic. As illustrated in FIGS. 5A, 5B each subwavelength acoustic metamaterials 66, 68, 70 is disposed such that adjacent surfaces are in contact to provide the multilayer (or stack) of composite materials. The multilayer acoustic absorber 64 is disposed on substrate (e.g. the surface or a vehicle such as airplane or other airborne vehicle or the surface of a submarine or other water-based vehicle or the surface of a truck or other ground-based vehicle.

As described above, each of the plurality of subwavelength acoustic metamaterials 66, 68, 70 comprises a composite material having channels provided therein. The channels may have a fluid or a gas disposed therein and the combination of at least the composite material characteristics, channel sizes, channel shapes and fluid or a gas characteristics provide each subwavelength acoustic metamaterial 66, 68, 70 having a desired acoustic absorption characteristic at a desired frequency or over a desired range of frequencies. Thus, in the illustrative embodiment of FIGS. 5A, 5B subwavelength acoustic metamaterial 66 is responsive to signals having a frequency of $f_1$, subwavelength acoustic metamaterial 68 is responsive to signals having a frequency of $f_2$ and subwavelength acoustic metamaterial 70 is responsive to signals having a frequency of $f_3$.

Comparing the embodiments of FIG. 5A and FIG. 5B, it can be seen that it is possible to vary the order in which the subwavelength acoustic metamaterials 66, 68, 70 may be arranged. Such variation may be desirable to increase the effectiveness (e.g. the absorption effectiveness) of the multiplayer acoustic structure 84 to best suit the needs of a particular application.

In one embodiment, a different fluid or gas may be disposed in some or all of the channels. The type and amount of fluid and/or gas to disposed in each channel may be selected such that each subwavelength acoustic metamaterial in the stack of subwavelength acoustic metamaterials 66, 68, 70 responds to a signal having a selected, different frequency $f_1$, $f_2$, $f_3$ (i.e. each subwavelength acoustic metamaterial in the stack responds to a different frequency). Thus, the order in which the each subwavelength acoustic metamaterial is arranged to form the stack is selected based, at least in part, upon some or all of: the needs of a particular application; characteristics of the medium surrounding the stack of subwavelength acoustic metamaterials; and the characteristics of a substrate (if any) on which the stack of subwavelength acoustic metamaterials is disposed.

Figure 6:
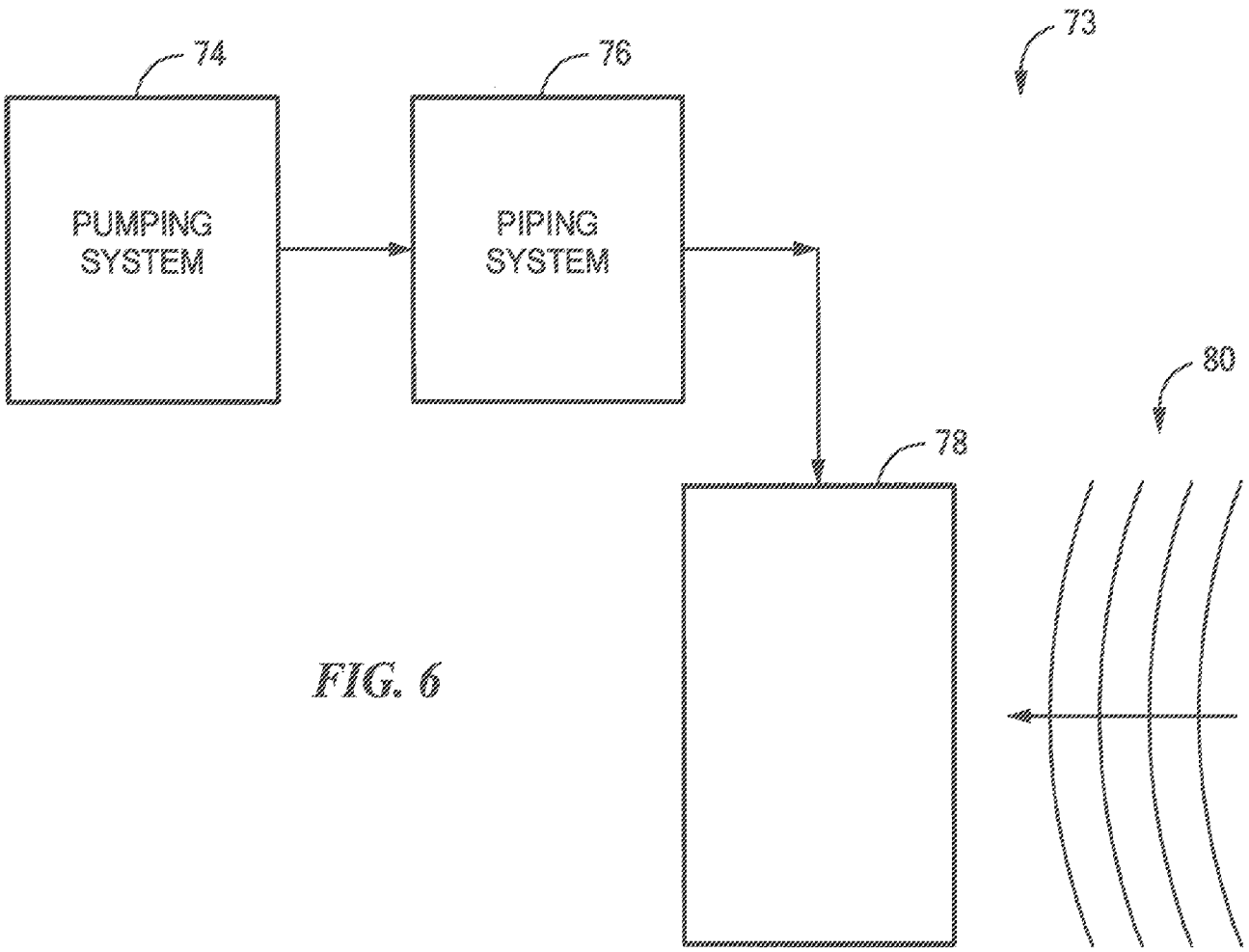
FIG. 6 is a block diagram of an acoustic absorbing system including a subwavelength acoustic metamaterial having tunable acoustic absorption at one or more frequencies.

Referring now to FIG. 6, an acoustic absorbing system 73 includes a pumping system 74 having a pump (not shown) with an output coupled to one or more pump ports of a piping system 76. The piping system 76 includes one or more absorber ports coupled to one or more ports of at least one channel provided in an acoustic absorbing structure 78 having a tunable acoustic absorption characteristic. Acoustic absorbing structure 78 may be the same as or similar to any of the acoustic absorbing structures described hereinabove (e.g. a single layer or a multilayer acoustic absorber.

The pumping system 74 may inject or otherwise introduce a fluid or a gas into one or more the channels provided in the acoustic absorbing structure 78 so as to provide a tunable acoustic absorption characteristic. By pumping (or otherwise injecting or introducing) fluid or gas into the channels or pumping fluid or gas out of the channels (i.e. or removing fluid or gas from some or all of channels) the response characteristic of the acoustic absorbing structure 78 may be varied. In particular, varying (e.g. adding or removing) gas or fluid from a subwavelength acoustic metamaterial, the response characteristics of the subwavelength acoustic metamaterial may be varied. In one embodiment, the pump and piping system or operated so as to add or remove gas or fluid from one or more channels within a composite material in which the channels exist.

Since at least one of the one or more channels has an aperture, a gas or fluid may be introduced to or removed from at least a portion of one or more of the channels. In one embodiment, a plurality (or all) of the channels may have their own respective aperture through which a gas or fluid may be injected or otherwise introduced into each channel. In some applications, it may be desirable that the same gas or fluid be introduced into each channel. In some applications, it may be desirable that a first gas or fluid be introduced into first ones of the channels and a second, different gas or fluid be introduced into second ones of the channels. In some applications, it may be desirable that a different gas or fluid be introduced into each channel. In some applications, it may be desirable that the same amount of gas or fluid be introduced into each channel. In some applications, it may be desirable that a first amount of gas or fluid be introduced into first ones of the channels and a second, different amount of gas or fluid be introduced into second ones of the channels. In some applications, it may be desirable that a different amount of gas or fluid be introduced into each channel. In some applications, it may be desirable to introduced a combination of a gas and fluid into some or all of the channels. Other combinations of gas and/or fluid types and amounts of gas and/or fluid may also be used. In short, the type of gas and/or fluid, the amount of gas and/or fluid and whether a combination of gas and fluid should be used in each channel may be selected in accordance with the needs of a particular application.

Figure 6A:
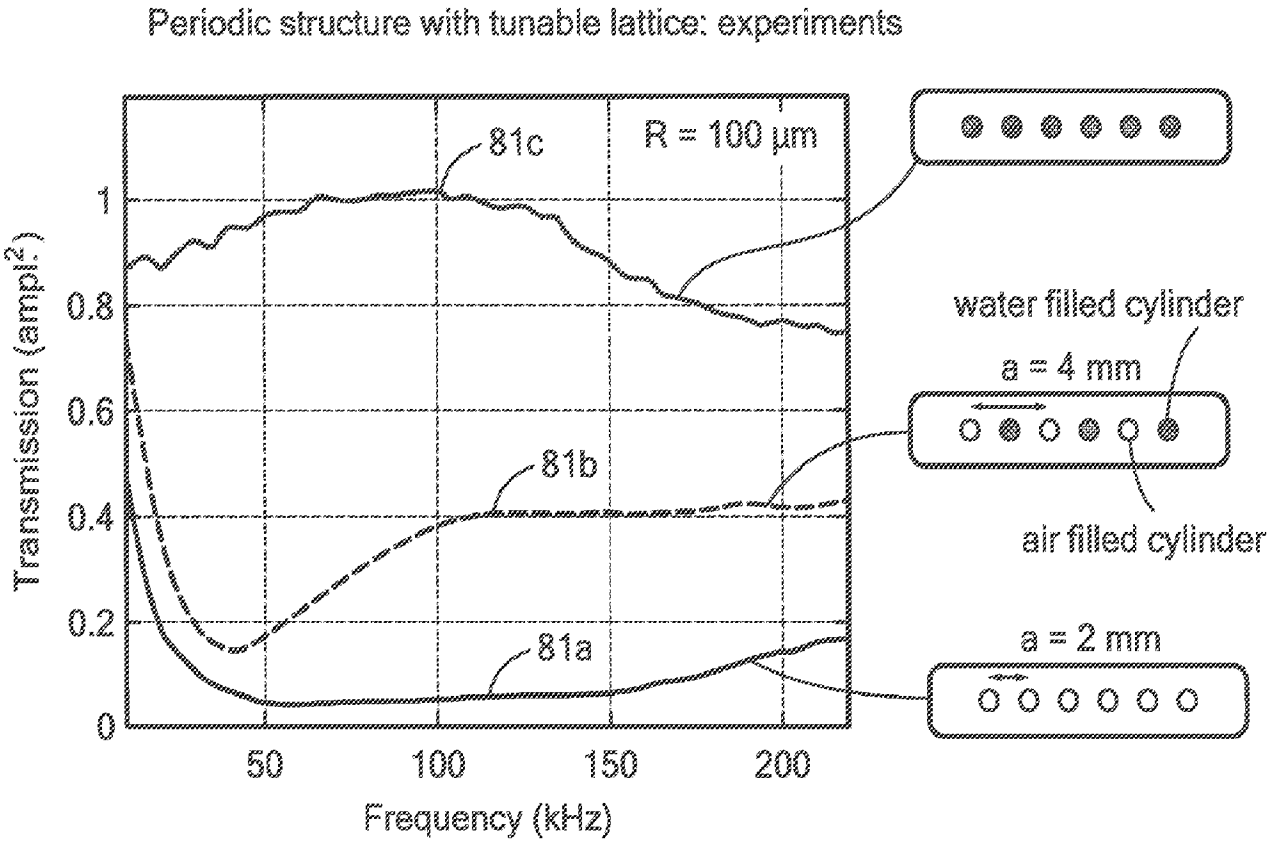
FIG. 6A is a plot of frequency vs. transmission amplitude for air-filled and water-filled channels provided in a subwavelength acoustic metamaterial.

Referring now to FIG. 6A transmission characteristics of a tunable absorption structure which may be the same as or similar to those described herein in conjunction with FIGS. 1-6, is shown. As can be seen from FIG. 6A, a curve labeled with reference numeral 81*a* represents the transmission characteristics of a structure having air filled cylinders having a radius of 100 μm and a center-to-center spacing of 2 mm (i.e. a lattice spacing of 2 mm). Curve 81*a* may be compared with curve 81*b* which represents the transmission characteristics of a structure having a combination of air filled cylinders and water filled cylinders with a center-to-center spacing of like cylinders of 4 mm (i.e. center the center-to-center spacing of air-filled cylinders is 4 mm and the center the center-to-center spacing of water-filled cylinders is 4 mm). In the illustrative embodiment of FIG. 6A, each of the cylinders has a radius of 100 μm and alternate cylinders are water filled. The shear modulus is of the order of 1 MPa and the bulk modulus K is of the order of 1 GPa.

The transmission characteristics of the above structures may, in turn, be compared with the transmission characteristics of a tunable absorption structure in which all channels have a radius of 100 μm and are water-filled (see curve labeled with reference numeral 81*c*).

Figure 7:
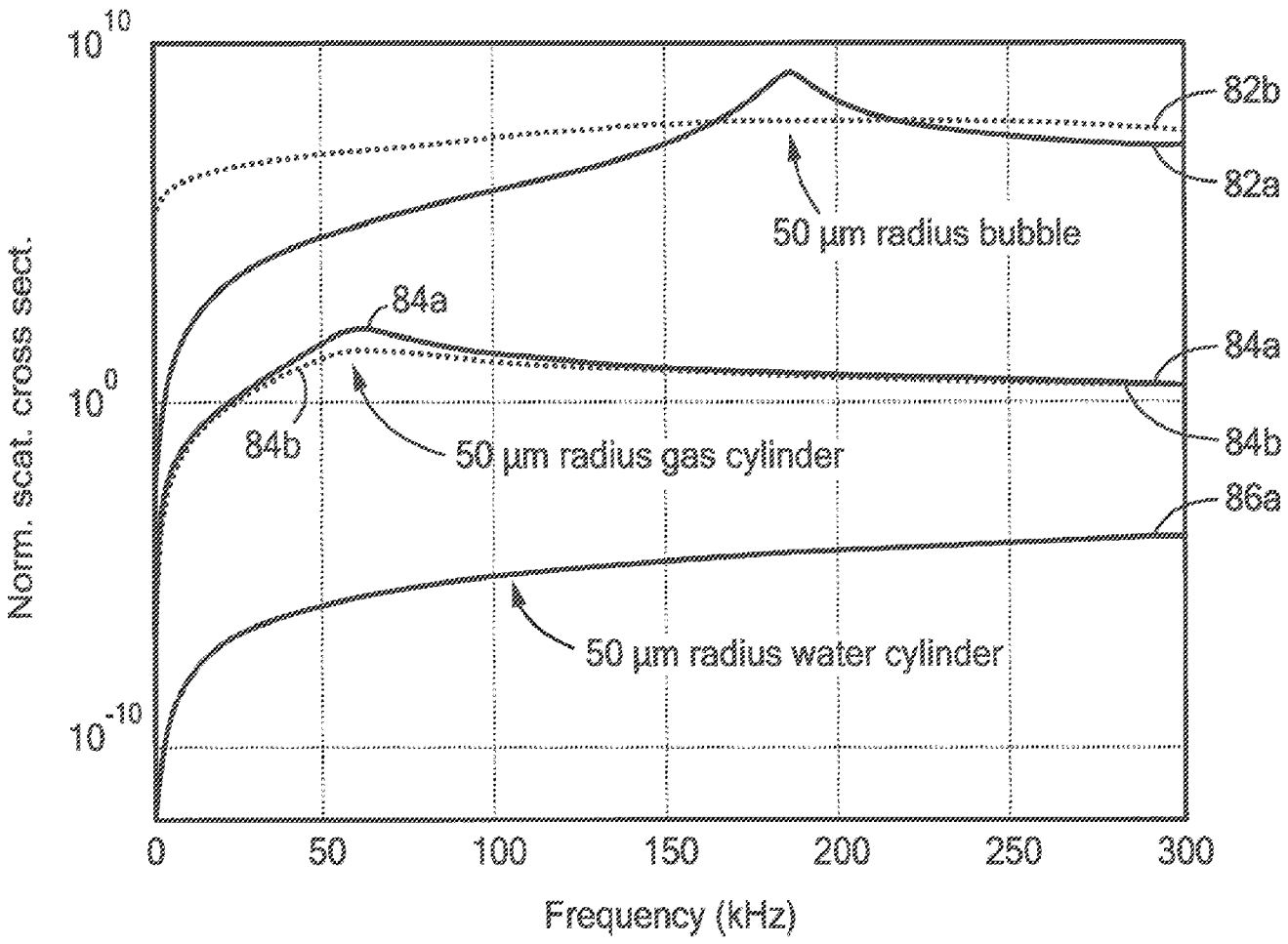
FIG. 7 is a plot of frequency vs. normalized scattering cross section per unit length of channel provided in a subwavelength acoustic metamaterial.

Referring now to FIG. 7, this figure compares the dimensionless scattering cross section of a 50 micron radius gas-filled cylinder with that of a 50 micron radius bubble both in a soft elastic matrix. The gas-filled cylinder also shows a strong monopole resonance having a frequency (60 kHz) which is much lower than that of the monopole resonance of the same radius bubble (180 kHz). Also shown is the dimensionless scattering cross section of a water filled cylinder (having a radius of 50 microns). At the gas filled cylinder monopole resonance, the water filled cylinder dimensionless scattering cross section is eight (8) times order of magnitude lower than that of the gas filled cylinder. Dotted lines include viscous losses. The dimensionless scattering cross section of the gas bubble is much bigger than that of the gas cylinder. For the bubble, the normalized scattering cross section is obtained by dividing by a value correspond to the radius squared ($r^2$) whereas for the cylinder it is divided by a value corresponding to the radius (r).

Figure 8B:
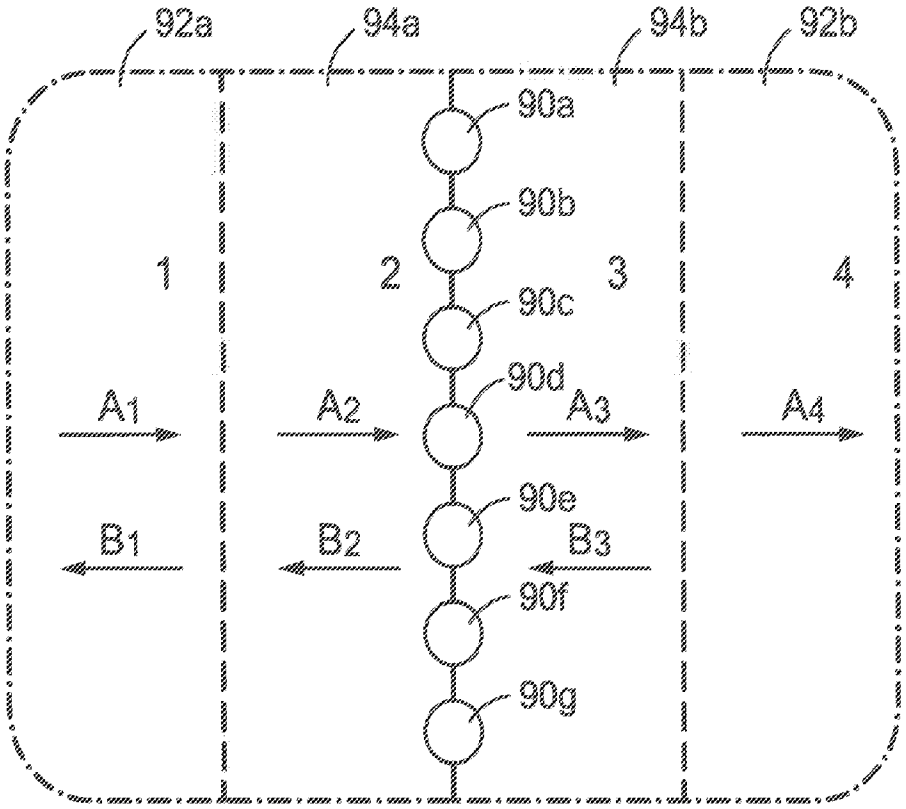
FIG. 8B is an enlarged view of a portion of the acoustic absorber of FIG. 8A, taken along lines 8B-8B in FIG. 8A.
Figure 8A:
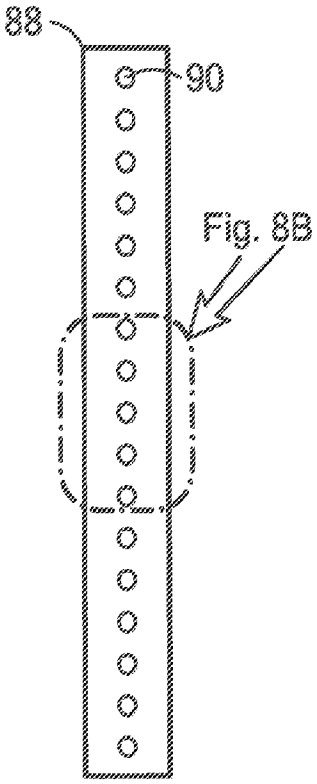
FIG. 8A is a top view of a portion of an acoustic absorber comprising a subwavelength acoustic metamaterial.

Referring now to FIGS. 8A and 8B, schematic representation of a membrane type metamaterial 88 having channels 90 provided therein. For the calculation of the reflection and transmission, the material is divided into two regions 94*a*, 94*b* separated by the linear array of hollow cylinders. The array is taken as a simple interface whose coefficients of reflection and transmission are calculated using a multiple scattering theory.

Figure 9:
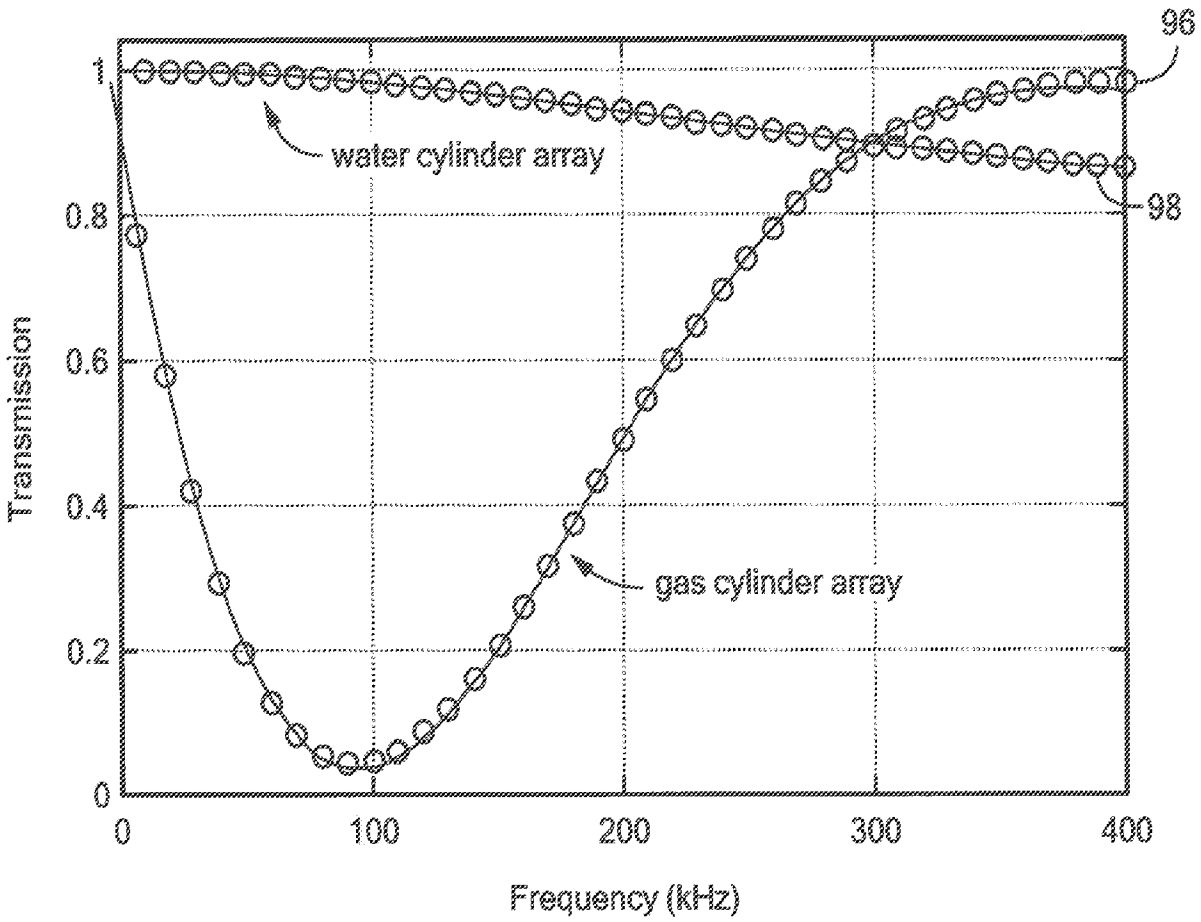
FIG. 9 is a plot of frequency vs. transmission for a subwavelength acoustic metamaterial provided from a composite material having channels provided therein.

Referring now to FIG. 9, the transmission characteristic of an absorbing structure having an array of gas-filled cylinders is compared with the transmission characteristic of an absorbing structure having an array of water-filled cylinders. In both cases, the cylinder have a radius of 50 microns and the distance between two nearest cylinders is 2 mm. The continuous line comes from the multiple scattering theory where finite thickness of the membrane has been taken into account. The circle correspond to simulated values. In the case of a water filled cylinder array, the transmission is also compared with that of a plain homogeneous slab of polydimethylsiloxane (PDMS). Both MST and homogeneous PDMS slab curves perfectly coincide. Multiple scattering is negligible in the case of water filled cylinder in PDMS (at low frequency).

Figure 10:
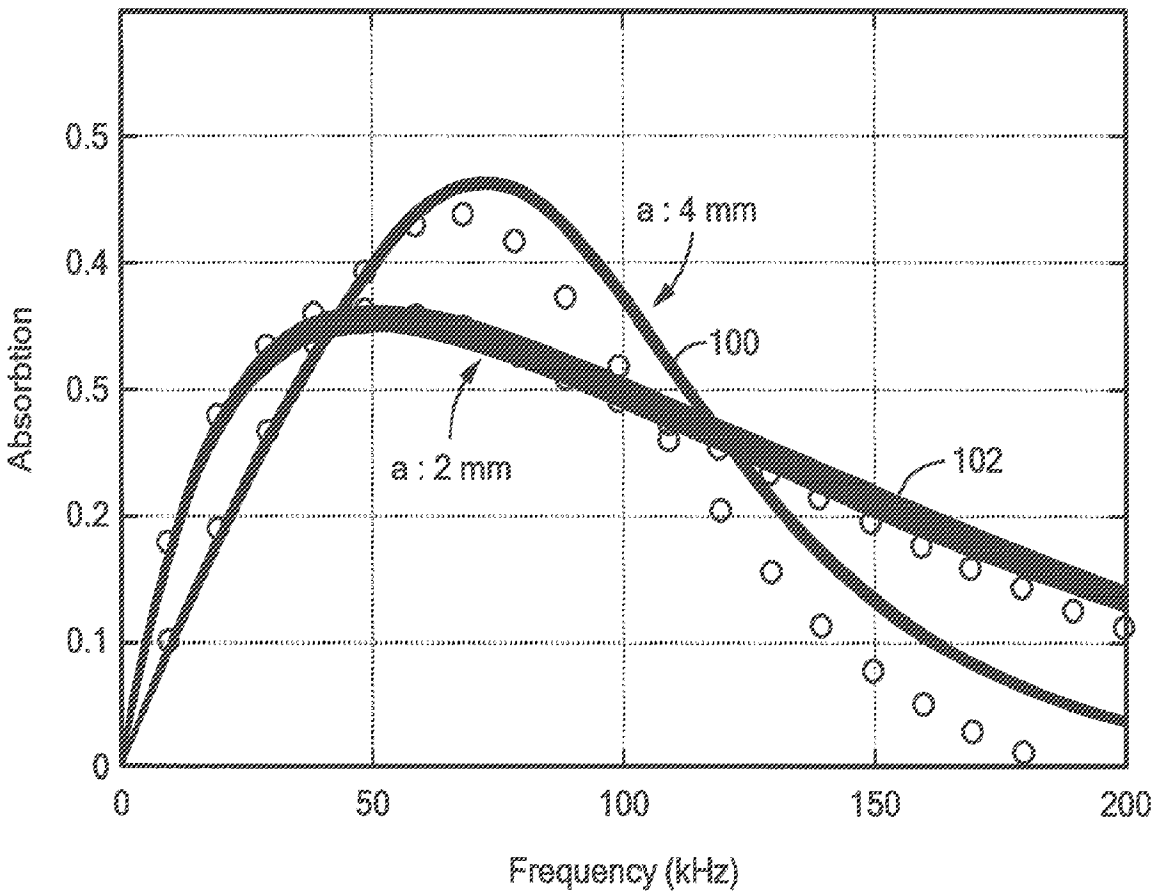
FIG. 10 is a plot of frequency vs. absorption for a subwavelength acoustic metamaterial provided from a composite material having channels provided therein.

Referring now to FIG. 10 shown is the absorption (A=1−r2−t2) in the slab, calculated from a multiple scattering model and compared with simulation values. When the grating is equal to 2 mm (see transmission curve of FIG. 9), the absorption reached 35% around 50 kHz. Interestingly, the absorption peak gets even higher (45%) when one fills every other cylinder with water—hence increasing the grating to 4 mm. Hollow channels (e.g. hollow cylinders) are an interesting alternative to closed (quasi spherical) cavities in soft elastic material for sound and vibrations dampening because: they provide an alternative geometry to study; they may be easier to manufacture (e.g. casting leads to a substantial cylindrical shape); they allow gas and/or fluid to be introduced into and/or removed from the channel; changing of the gas and/or fluid inside the channels can dramatically alter the coupling between the channels and change the frequency response of the material. Applications include but are not limited to sound and vibration mitigation, and skin treatment.

Figure 11:
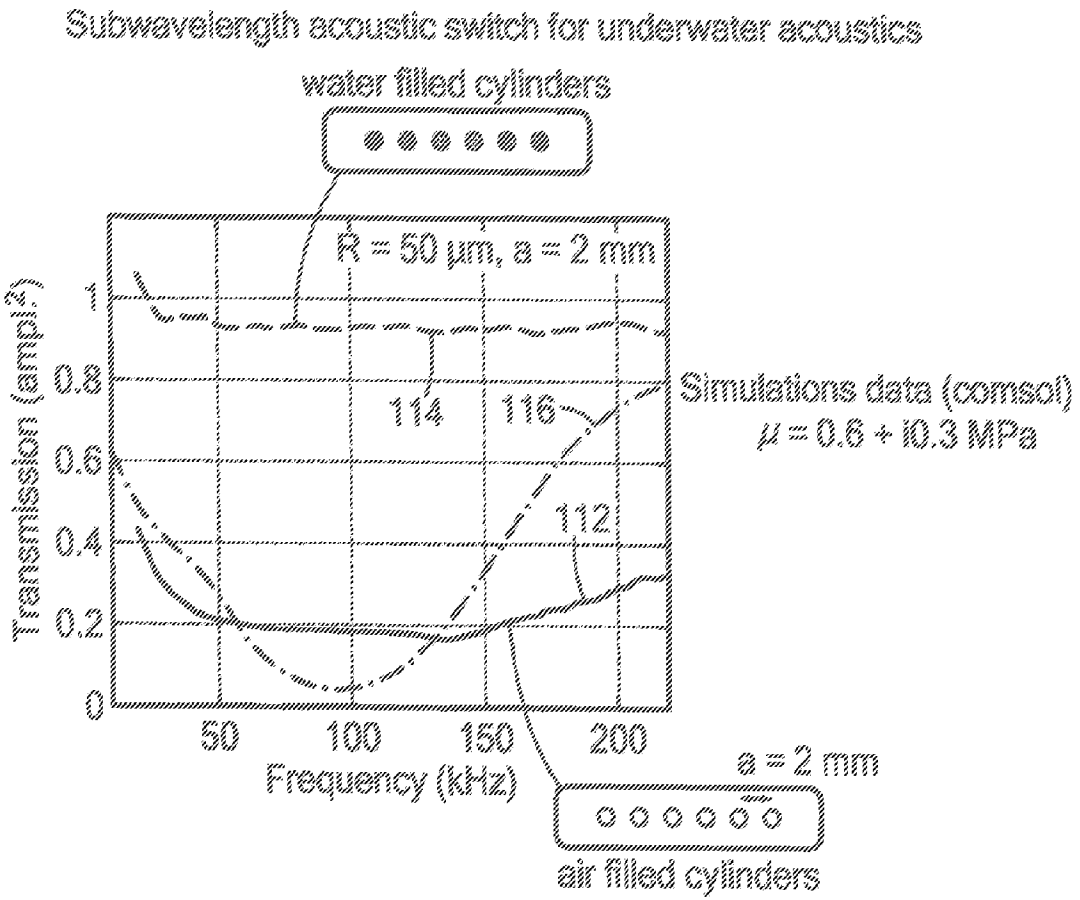
FIG. 11 is a plot of frequency vs. transmission for a subwavelength acoustic switch.

Referring now to FIG. 11, a prototype sample of an acoustic switch suitable for use in under water acoustics may be fabricated as follow. Tens of 100 microns diameter PET wires are stretched on one same plane, parallel to each other and equally spaced (2 mm pitch) over a 3d printed mold (2 mm thick). The plane of the wires is located 1 mm above the floor of the mold which is cast with polydimethylsiloxane) (PDMS/silicone rubber). Once the latter is cured, the wires are carefully stripped off the sample. The resulting sample is a 2 mm thick soft elastic (PDMS) sheet (μ around 1 MPa), with parallel empty (air filled) cylinders, regularly spaced (pitch or lattice constant equal to 2 mm) on a plane in the middle of the sheet.

As shown in FIG. 11, curve 112 illustrates the transmission characteristics when the cylinders are air-filled while curve 114 illustrates the transmission characteristics when the cylinders are water-filled.

While particular embodiments of concepts, systems, circuits and techniques have been shown and described, it will be apparent to those of ordinary skill in the art that various changes and modifications in form and details may be made therein without departing from the spirit and scope of the concepts, systems and techniques described herein. After the reading the disclosure provided herein, those of ordinary skill in the art will now appreciate that combinations or modifications not specifically described herein are also possible.

Having described preferred embodiments which serve to illustrate various concepts, systems, methods and techniques which are the subject of this patent, it will now become apparent to those of ordinary skill in the art that other embodiments incorporating these concepts, systems circuits and techniques may be used. For example, it should be noted that individual concepts, features (or elements) and techniques of different embodiments described herein may be combined to form other embodiments not specifically set forth above. Furthermore, various concepts, features (or elements) and techniques, which are described in the context of a single embodiment, may also be provided separately or In any suitable sub-combination. It is thus expected that other embodiments not specifically described herein are also within the scope of the following claims.

In addition, it is intended that the scope of the present claims include all other foreseeable equivalents to the elements and structures as described herein and with reference to the drawing figures. Accordingly, the subject matter sought to be protected herein is to be limited only by the scope of the claims and their equivalents.

It also be appreciated that elements of different embodiments described herein (e.g. elements or features described in conjunction with any of FIGS. 1-13) may be combined to form other embodiments which may not be specifically set forth herein. Various elements, which are described in the context of a single figure or embodiment, may also be provided separately or in any suitable subcombination. Other embodiments not specifically described herein are also within the scope of the following claims.

It is felt, therefore that the concepts, systems, circuits and techniques described herein should not be limited by the above description, but only as defined by the spirit and scope of the following claims which encompass, within their scope, all such changes and modifications.

All publications and references cited herein are expressly incorporated herein by reference in their entirety.

What is claimed is:

1. An acoustic absorbing system comprising:

a pumping system having a pump with an output;

a piping system having one or more pump ports coupled to the pump output of said pumping system and having one or more absorber ports; and a subwavelength acoustic metamaterial having one or more channels provided therein with at least one of the one or more channels coupled to at least one of the one or more absorber ports of said piping system.

2. The acoustic absorbing system of claim 1 wherein said subwavelength acoustic metamaterial comprises a composite material having one or more channels provided therein wherein the channels are provided having dimensions such that in response to a low frequency sound wave intercepted by said composite material, the channels exhibit a low frequency resonance such that a wall of each channel oscillates in a plane which is substantially perpendicular to a central longitudinal axis of the channel.

3. The acoustic absorbing system of claim 1 wherein said subwavelength acoustic metamaterial comprises a composite material having one or more hollow cylinders provided therein wherein the hollow cylinders are provided having dimensions selected to exhibit a low frequency resonance in response to a low frequency sound wave provided thereto, and wherein walls which define the hollow cylinders oscillate isotropically in a plane which is substantially perpendicular to a central longitudinal axis of the hollow cylinder in response to the low frequency sound wave.

4. The acoustic absorbing system of claim 1 wherein in response to said pumping system providing one of a fluid or a gas to at least one of the one or more channels in said subwavelength acoustic metamaterial, an acoustic absorption characteristic of said acoustic absorbing system changes.

5. The acoustic absorbing system of claim 1 wherein said subwavelength acoustic metamaterial is provided as a multilayer acoustic absorber comprising a plurality of multilayer composite materials, each of said plurality of multilayer composite materials having one or more channels provided therein with at least some of the one or more channels having an exposed aperture coupled to at least one of the one or more absorber ports of said piping system.

6. The acoustic absorbing system of claim 5 wherein at least some of the channels having a single exposed aperture coupled to at least one of the one or more absorber ports of said piping system.

7. The acoustic absorbing system of claim 5 wherein at least some of the channels having first and second apertures exposed on first and second surfaces of a composite material and each of the apertures are coupled to an absorber port of said piping system.

8. The acoustic absorbing system of claim 1 wherein the channels have at least one closed end.

9. The acoustic absorbing system of claim 1 wherein the one or more channels have a diameter between about 50 microns and 200 microns.

10. The acoustic absorbing system of claim 1 wherein the one or more channels are filled with a fluid or gas that has a density greater than the density of air.

11. The acoustic absorbing system of claim 1 wherein the metamaterial includes an elastic matrix and the one or more channels are filled with a fluid having a density that is about the same as a density of the elastic matrix.

* * * * *